US006341613B1

(12) United States Patent
Wu et al.

(10) Patent No.: US 6,341,613 B1
(45) Date of Patent: Jan. 29, 2002

(54) FOLDING DEVICE FOR UMBRELLA

(76) Inventors: Chieh-Chih Wu; Ching-Tsai Chen; Chen-Maan Chang, all of No. 380, Lun Mei Rd., Chang Hwa City (TW)

( * ) Notice: Subject to any disclaimer, the term of this patent is extended or adjusted under 35 U.S.C. 154(b) by 0 days.

(21) Appl. No.: 09/610,529

(22) Filed: Jul. 7, 2000

(30) Foreign Application Priority Data

Dec. 17, 1999 (TW) ..... 088221515

(51) Int. Cl.[7] ..... A45B 25/14
(52) U.S. Cl. ..... 135/24; 135/22; 135/25.1
(58) Field of Search ..... 135/22, 24, 25.1, 135/25.3, 25.4

(56) References Cited

U.S. PATENT DOCUMENTS 5,492,140 A * 2/1996 Lin et al. ..... 135/24
5,626,160 A * 5/1997 Ko ..... 135/22
5,632,290 A * 5/1997 Kuo ..... 135/24
5,823,215 A * 10/1998 Chou et al. ..... 135/24
5,868,151 A * 2/1999 Kuo ..... 135/24
5,992,433 A * 11/1999 Chung-Kuang et al. ..... 135/24
6,016,822 A * 1/2000 Lin et al. ..... 135/24
6,112,755 A * 9/2000 Lin et al. ..... 135/24
6,176,246 B1 * 1/2001 Lin et al. ..... 135/24
6,196,243 B1 * 3/2001 Chen ..... 135/22

* cited by examiner

*Primary Examiner*—Winnie S. Yip
(74) *Attorney, Agent, or Firm*—Rosenberg, Klein & Lee

(57) ABSTRACT

A foldable umbrella includes a control device on the handle of the umbrella and the control device includes a ring which has a projection that is engaged three aligned holes in three tubes of a shaft when the when the umbrella is folded. An end member is connected to a wire which reeves through pulleys on a finishing cap and a runner on the shaft. The end member is compressed by a compressing plate in the control device. The ring is pushed by pushing a control button at a first time to disengage the projection from the aligned holes to let the shaft expand. The control button is pushed at a second time to remove the end member from the compressing plate to fold the umbrella.

5 Claims, 8 Drawing Sheets

FOLDING DEVICE FOR UMBRELLA

FIELD OF THE INVENTION

The present invention relates to a folding device for umbrella and includes a control device which controls expansion of retracted tubes by a button and two wires are connected between a moving member in the tubes and a finishing cap of the umbrella. One of the wires is connected to a runner so that the runner moves with the expansion of the tubes to expand the umbrella.

BACKGROUND OF THE INVENTION

A conventional umbrella generally includes a shaft with a runner movably mounted to the shaft. A finishing cap is connected to a top of the shaft and a plurality of ribs are pivotally and radially connected to the finishing cap so that a fabric is connected to the ribs. A plurality of stretchers are pivotally connected between the ribs and the runner. A bottom stop and a top stop are respectively received in the shaft and biased by two respective springs. When the runner is engaged with the bottom stop, the umbrella is at its folded status and when the runner is engaged with the top stop, the ribs extend and the umbrella is expanded. The runner is pushed by a user along the shaft to expand the umbrella from the lower stop to the top stop when expanding the umbrella. It is inconvenience for the users to expand the umbrella when the other hand carrying a bag or the like. An automatic umbrella is then developed and includes a control button which is pushed to let the runner run toward the finishing cap to expand the umbrella. Nevertheless, this type of automatic mechanism is not used for an umbrella having a shaft composed of more than two retractable tubes.

The present invention intends to provide folding device for umbrella wherein the umbrella has a shaft with four retractable tubes and the umbrella can be expanded or folded by pushing a button once.

SUMMARY OF THE INVENTION

In accordance with one aspect of the present invention, there is provided a foldable umbrella comprising a finishing cap with a plurality of first ribs pivotally connected thereto. A fabric is mounted to the ribs and first pulley is received in the finishing cap. A shaft is connected to the finishing cap and comprises a plurality of tubes which are retractably connected with each other. Each tube has a hole defined through a periphery thereof. A handle tube is connected to a low end of the shaft and a control device is connected to the handle tube. The handle tube has a first aperture and a second aperture defined therethrough. A runner is movably mounted to the shaft and a plurality of stretchers are pivotally connected between the runner and the ribs. A spring is received in the shaft and has a first end thereof engaged with a retaining tube which is movably received in the shaft.

A first wire has a first end thereof fixedly connected to the finishing cap and a second of the first wire reeves through a second pulley in the runner and the first pulley in the finishing cap and is then fixedly connected to a first block received in the retaining tube. An end member is movably received in the shaft and has an engaging head. A second wire has a first end thereof fixedly connected to the end member and a second end of the second wire extends through a second block which is received in the retaining tube and located between the first block and the end member. The second end of the second wire reeves through a fourth pulley in the first block and is fixedly connected to the second block. A second end of the spring is engaged with the engaging head of the end member.

The control device comprises a base member and a central passage defined through the base member in which the handle tube is received. A slot is defined through a periphery of the base member and communicates with the central passage. An opening is defined in the periphery of the base member and communicates with the central passage. A carrying member is movably inserted in the opening and has a hole defined therein which is in alignment with the central passage. A spring is biased against a bottom of the carrying member. A protrusion extends from the carrying member and is movably engaged with the slot. A groove is defined in an inner periphery of the central passage and a ring is movably received in the groove. A projection extends radially inward from an inner periphery of the ring. A tube is fixedly engaged with the central passage in the base member and received in the handle tube. A tunnel is defined through the tube and communicates with the first aperture and the second aperture in the handle tube. A pressing plate is connected to the tube and has a convex portion which is inserted in the tunnel and presses against the end member when the umbrella is folded. The projection is inserted in the tunnel and engaged with the holes in the retracted tubes of the shaft when the umbrella is folded.

A first button has a plate and a tongue extends from the plate. A spring is mounted to the tongue and biased between the plate and the carrying member. A second button has a board and the ring and the plate of the first button both contact the board.

The primary object of the present invention is to provide a foldable umbrella wherein the umbrella is expanded by pushing a button and folded by pushing the button again.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
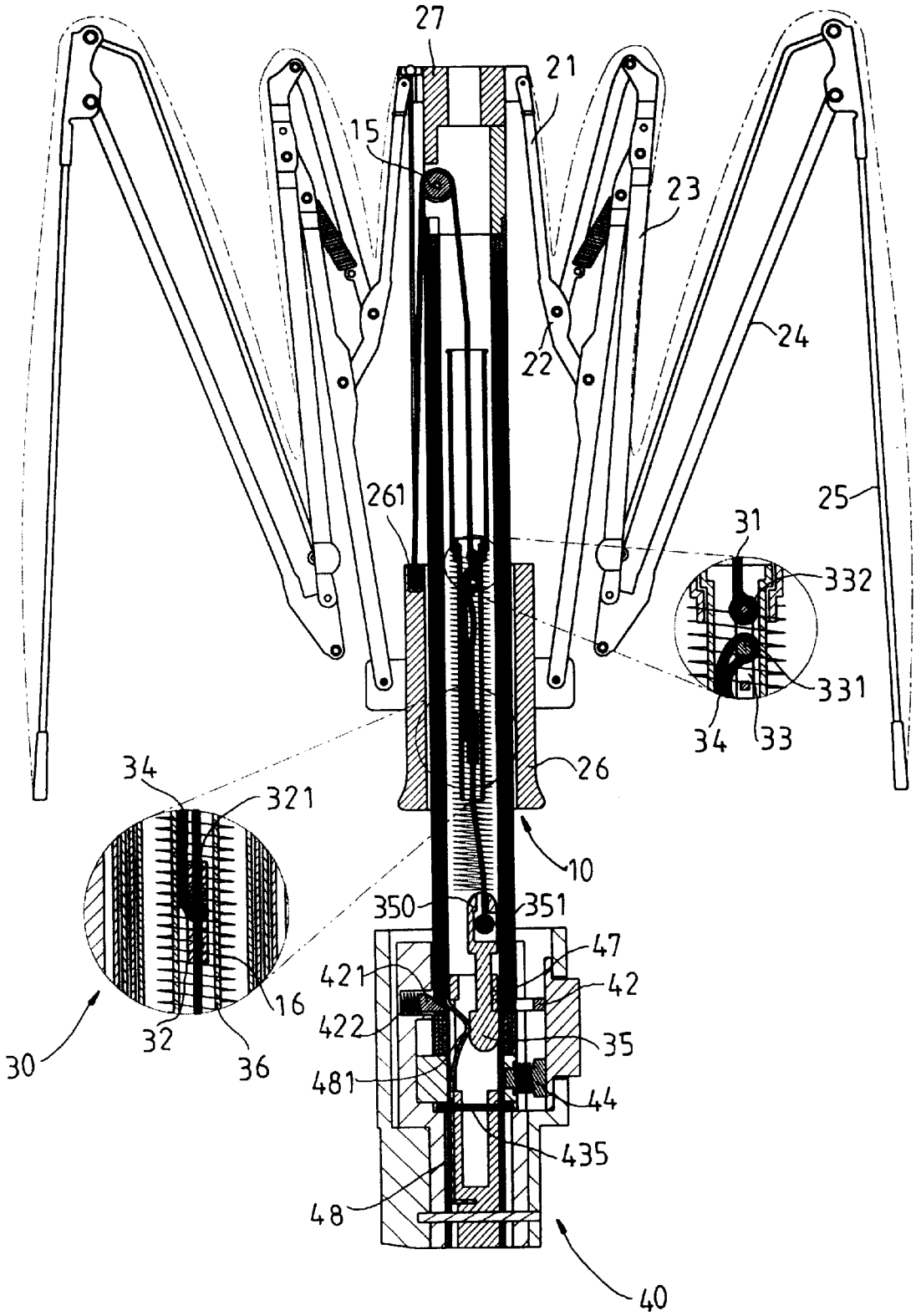
FIG. 1 is a cross sectional view to show a foldable umbrella of the present invention.
Figure 2:
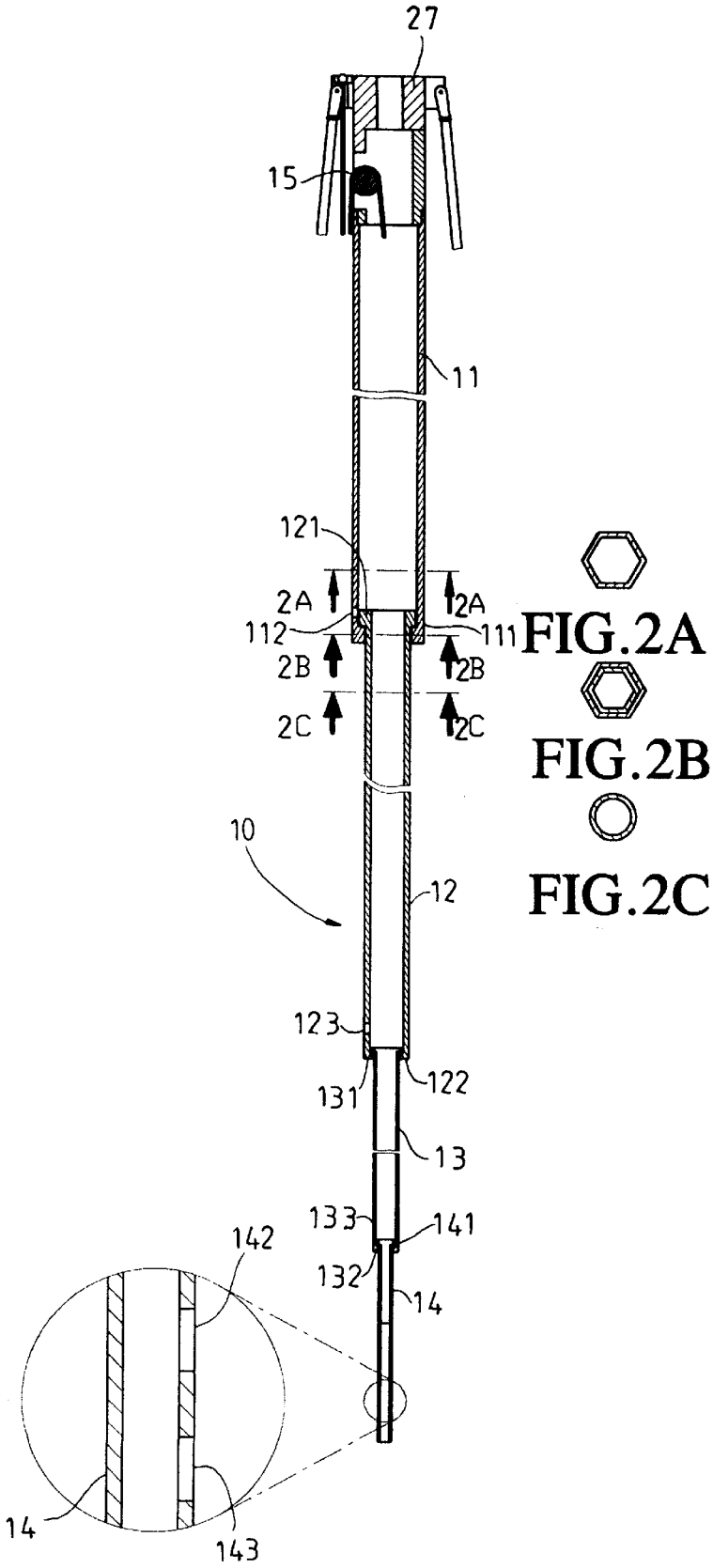
FIG. 2 shows a structure of a shaft of the umbrella of the present invention.
Figure 3:
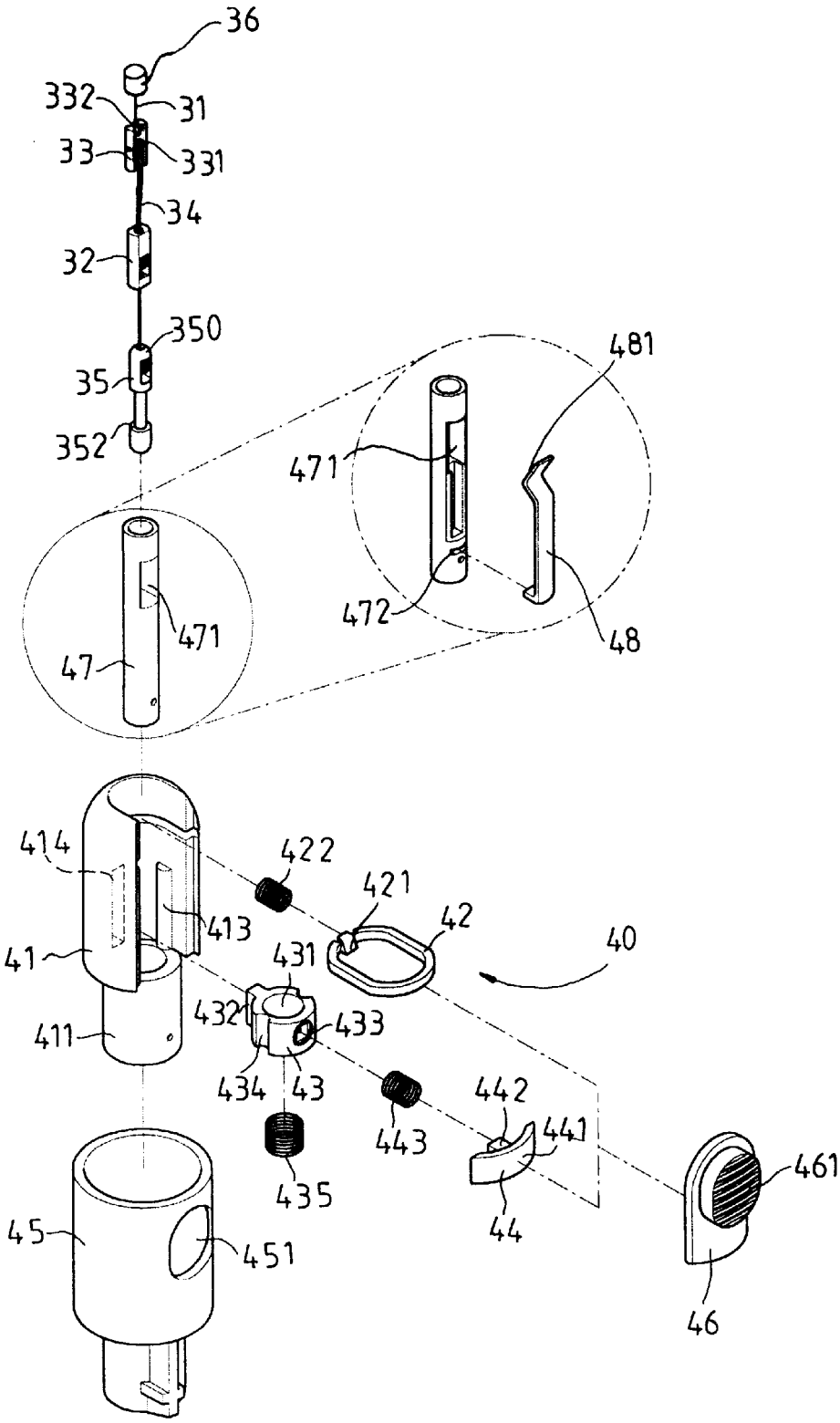
FIG. 3 is an exploded view to show a control device of the umbrella of the present invention.
Figure 4:
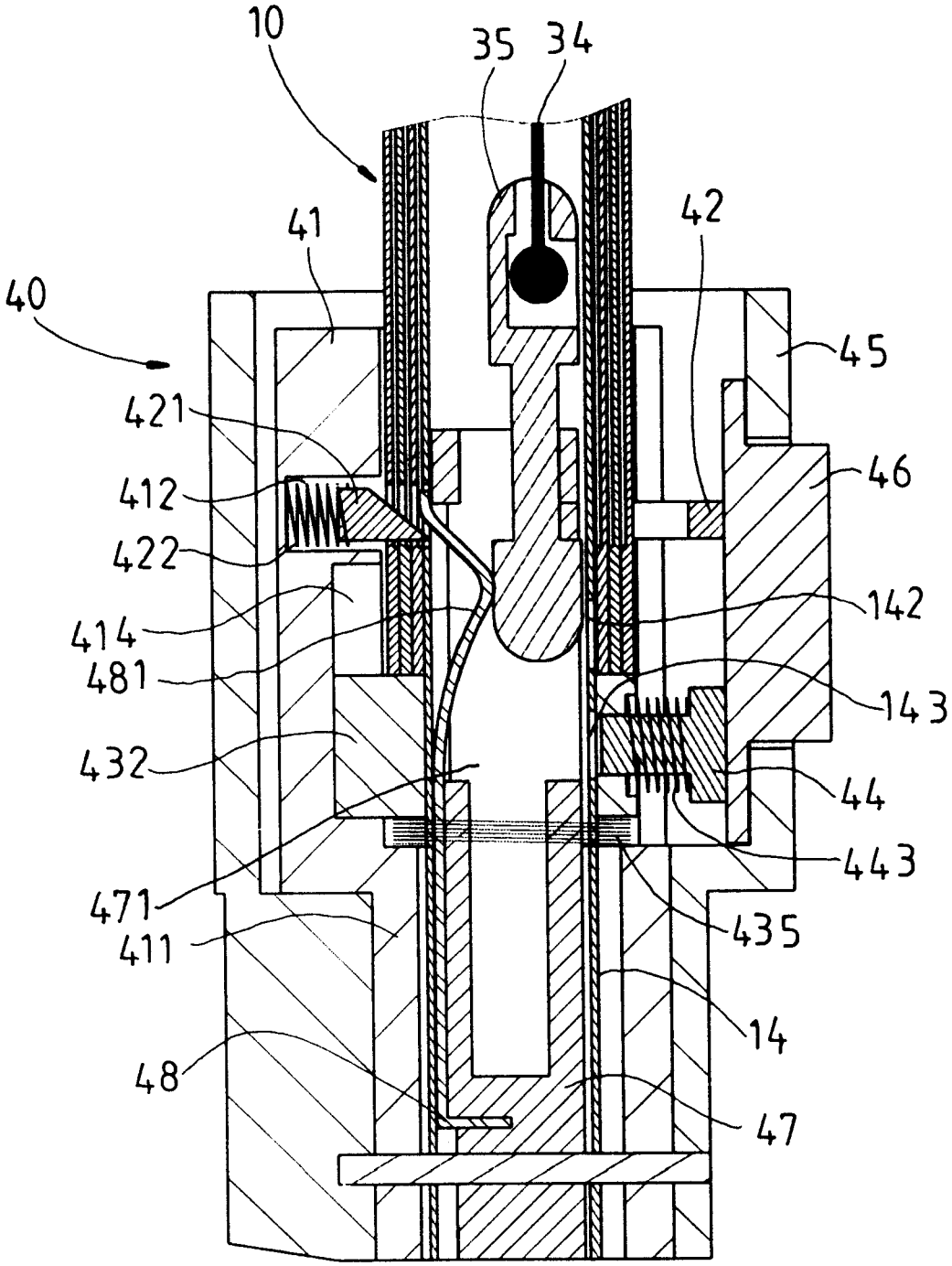
FIG. 4 is a cross sectional view to show the control device when the umbrella is in a foldable status.

Referring to FIGS. 1 to 4, the foldable umbrella of the present invention comprises a finishing cap 27 with a plurality of first ribs 21 pivotally connected thereto and a first pulley 15 received in the finishing cap 27. A shaft 10 is connected to the finishing cap and is composed of three tubes 11, 12 and 13 which are retractably connected with each other. As shown in FIG. 2, each of the tubes 11, 12 and 13 has a lower open end and a flange 111/122/132 extends radially inward from the lower open end. Two of the three tubes 11, 12 and 13 respectively has a flange 121/131 extending radially outward from a top end thereof so that the flanges 121, 131 is engaged with the flanges 111 and 122 when the shaft 10 is extended. A handle tube 14 is connected to a low end of the shaft 10 and a control device 40 is connected to the handle tube 14. The handle tube 14 has a first aperture 142 and a second aperture 143 defined therethrough. The handle tube 14 has a flange 141 extending radially outward from a top end thereof so as to be engaged with the flange 132 of the third tube 13. Each of the tubes 11, 12, and 13 has a hole 112/123/133 defined through a periphery thereof and the three holes 112, 123, 133 are in alignment with other when the tubes 11, 12 and 13 are retractable. A runner 26 is movably mounted to the shaft 10 and a plurality of stretchers 22 are pivotally between the runner 26 and the ribs 21. Three sub-ribs 23, 24 and 25 are pivotally connected with each other and the sub-rib 23 is pivotally connected to the stretcher 22. A fabric mounted to the ribs 21.

A spring 16 is received in the shaft 10 and a first end of the spring 16 is engaged with a retaining tube 36 which is movably received in the shaft 10. A first wire 31 has a first end thereof fixedly connected to the finishing cap 27 and a second of the first wire 31 reeves through a second pulley 261 in the runner 26 and the first pulley 15 in the finishing cap 27 and then is fixedly connected to a rod 332 in a first block 33 received in the retaining tube 36. An end member 35 is movably received in the shaft 10 and has an engaging head 350. A second wire 34 has a first end thereof fixedly connected to the end member 35 and a second end of the second wire 34 extends through a hole (321) in a second block 32 which is received in the retaining tube 36 and located between the first block 33 and the end member 35. The second end of the second wire 34 reeves through a third pulley 331 in the first block 33 and is then fixedly connected to the second block 32. A second end of the spring 16 is engaged with the engaging head 350 of the end member 35.

The control device 40 comprises a base member 41 and a central passage defined through the base member 41 in which the handle tube 14 is received. A neck 411 extends from the control device 40 and the base member 41 is received in a casing 45. A slot 414 is defined through a periphery of the base member 41 and communicates with the central passage. An opening is defined in the periphery of the base member 41 and communicates with the central passage, wherein the opening is located diametrically opposite to the slot 414. The casing 45 has a hole 451 which communicates with the opening in the base member 41. A groove 412 is defined in an inner periphery of the central passage and a ring 42 is movably received in the groove 412. A spring 422 is biased between the ring 42 and the an inner periphery of the groove 412. A projection 421 extends radially inward from an inner periphery of the ring 42 and the projection 421 has an inclined surface. Two ridges 413 extend radially from the inner periphery of the central passage in the base member 41.

A carrying member 43 is movably inserted in the opening and has a first hole 431 defined therein which is in alignment with the central passage of the base member 41. A spring 435 is biased against a bottom of the carrying member 43. A protrusion 432 extends from the carrying member 43 and is movably engaged with the slot 414. Two notches 434 are defined in two sides of the carrying member 43 so that the two ridges 413 are engaged with the notches 434. A second hole 433 is defined in an end of the carrying member 43 and which communicates with the first hole 431 in the carrying member 43.

A tube 47 is received in the handle tube 14 and is fixedly engaged with the central passage in the base member 41. A tunnel 471 is defined through the tube 47 and communicates with the first aperture 142 and the second aperture 143 in the handle tube 14. A slit 472 is defined in an outer periphery close to a lower end thereof and a pressing plate 48 having one end thereof inserted into the slit 472 and the other end of the compressing plate 48 is a convex portion 481 which is inserted in the tunnel 471 and presses against the end member 35 when the umbrella is folded. The convex portion 481 is located in alignment with the first aperture 142 of the handle tube 14 and the engaging member 35 has a shoulder portion 352 which is engaged with a periphery defining the tunnel 471 of the tube 47. It is to be noted that the projection 421 inserted in the tunnel 471 and engaged with the aligned holes 112/123/133 in the retracted tubes 11, 12 and 13 of the shaft 10 when the umbrella is folded.

A first button 44 includes a curved plate 441 and a tongue 442 extends from the plate 441. A spring 443 is mounted to the tongue 442 and biased between the plate 441 and the carrying member 43. A second button 46 has a board which is large enough that the ring 42 and the plate 441 of the first button 44 contact the board. A protrusion 461 extends from the board of the second button 46 and is accessed via the hole 451 of the casing 45.

Figure 5:
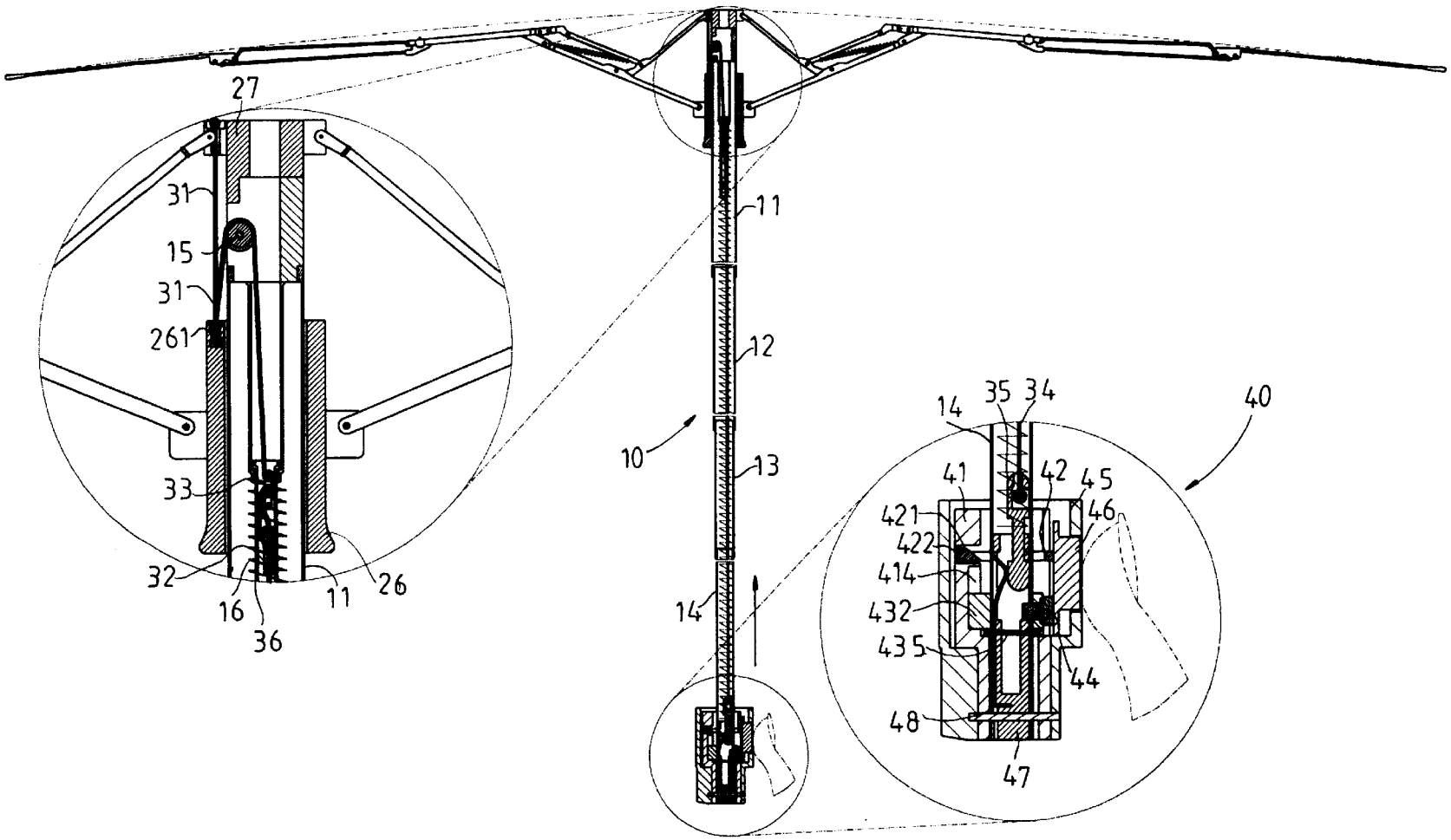
FIG. 5 is an illustrative view to show when the button is pushed, the umbrella of the present invention expands.
Figure 6B:
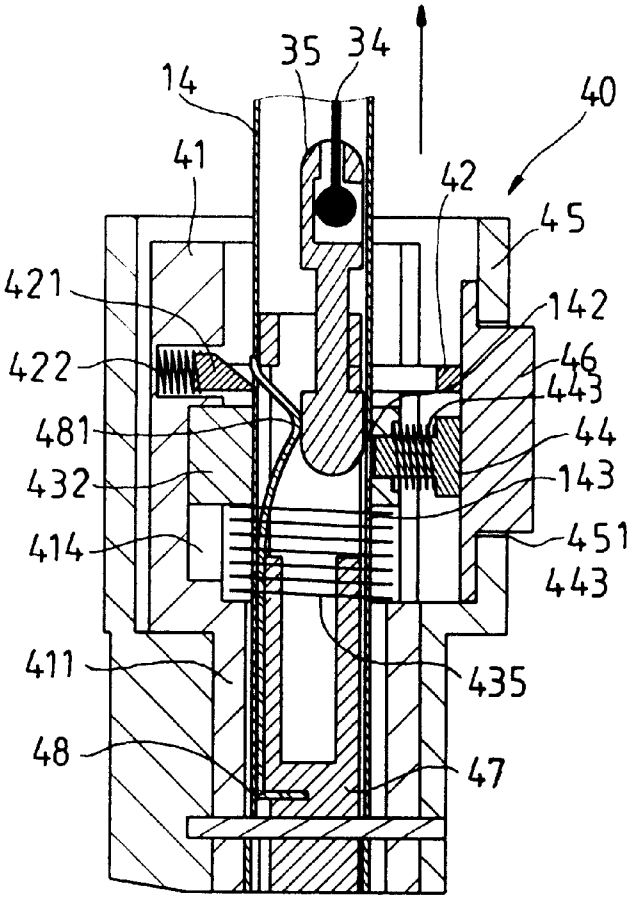
FIG. 6B is a cross sectional view to show a carrying member is moved upward after the button of the control device is pushed to let the shaft extend.
Figure 6A:
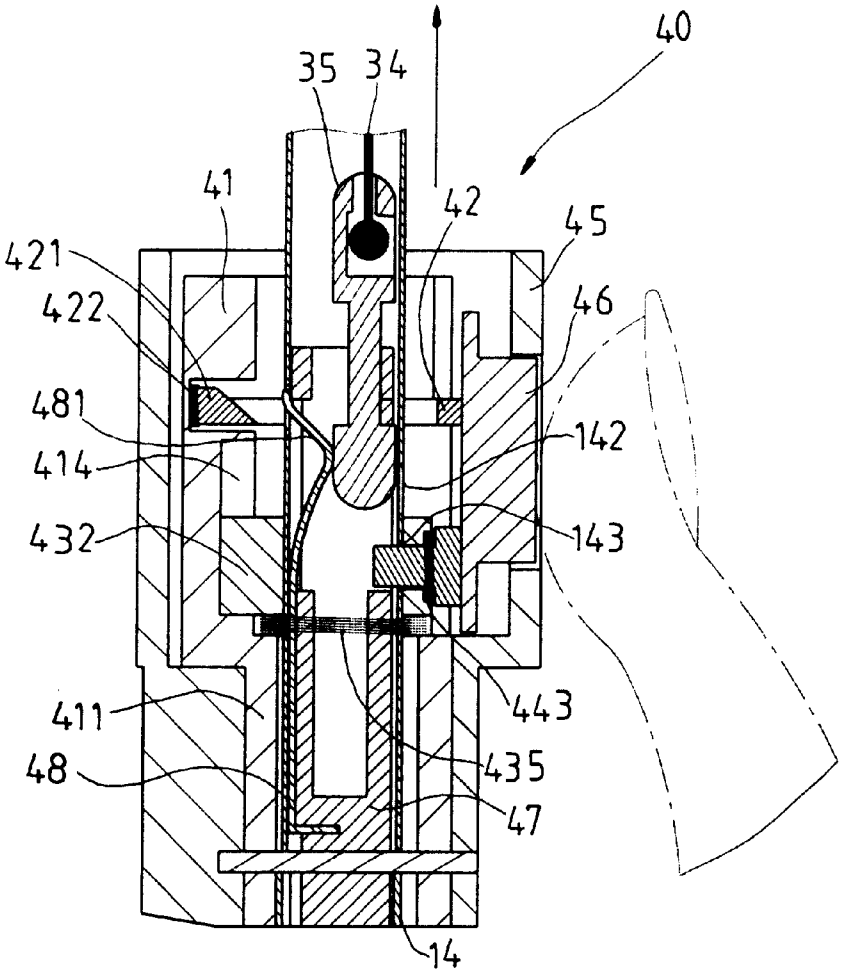
FIG. 6A is a cross sectional view to show when the button of the control device is pushed to let the shaft extend.

Referring to FIGS. 5 and 6A, when expanding the umbrella, the user pushes the protrusion 461 of the second button 46 to push the ring 42 so that the projection 421 is disengaged from the aligned holes 112, 123, 133. The three tubes 11, 12 and 13 bounce and expand by the spring 16, the retaining tube 36 is then pulled by the first wire 31 and the second wire 34. When releasing the second button 46, the first button 44 is bounced back by the spring 443 and the carrying member 43 is moved upward by the spring 435. The carrying member 43 is stopped when the protrusion 432 is engaged to a top edge of the slot 414. The second button 44 is moved upward together with the carrying member 43 because the tongue 442 is inserted into the second hole 433. The tongue 442 is now inserted into the first aperture 142

Figure 7:
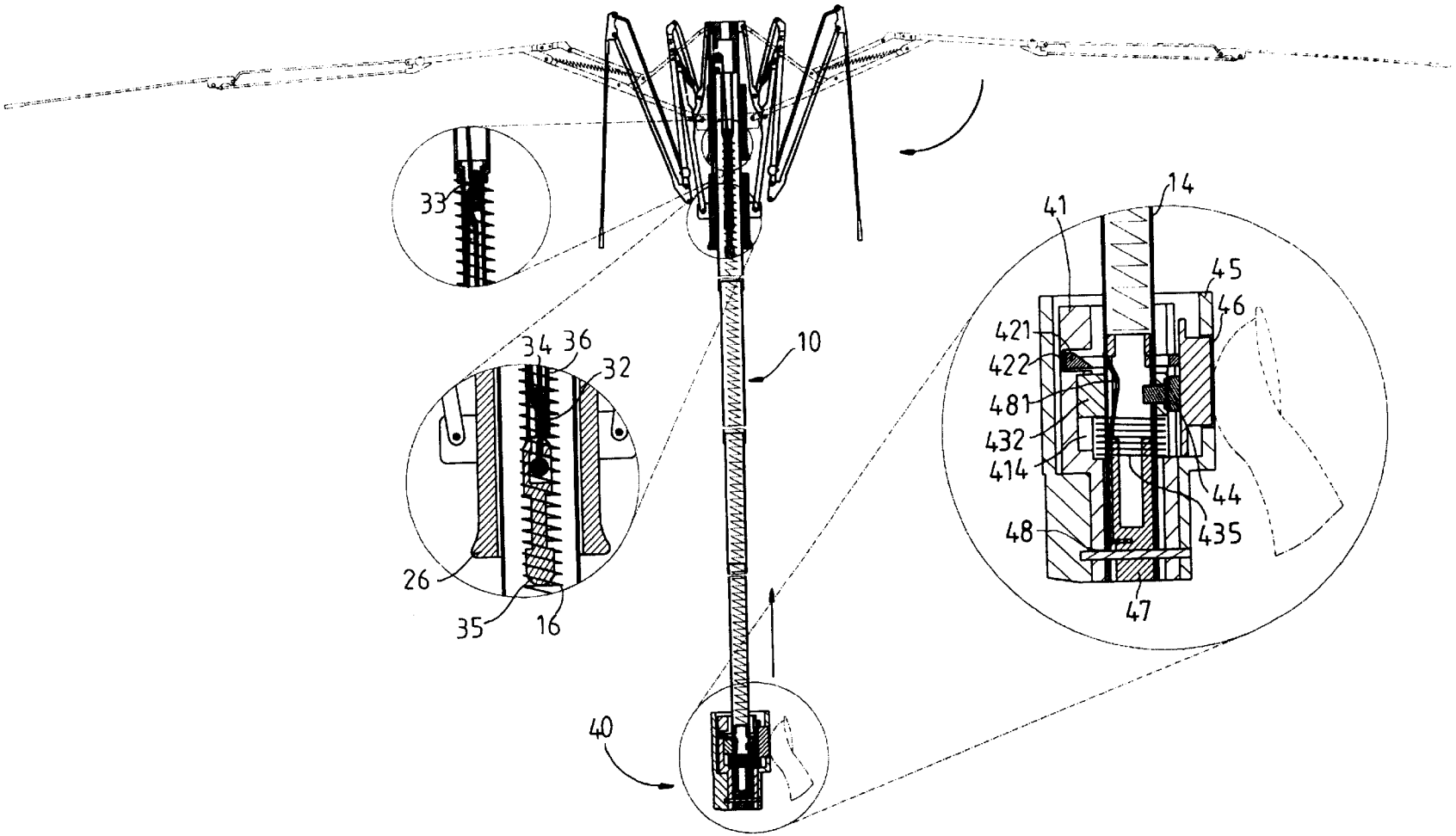
FIG. 7 is an illustrative view to show when the button is pushed again, the umbrella of the present invention is folded.
Figure 8B:
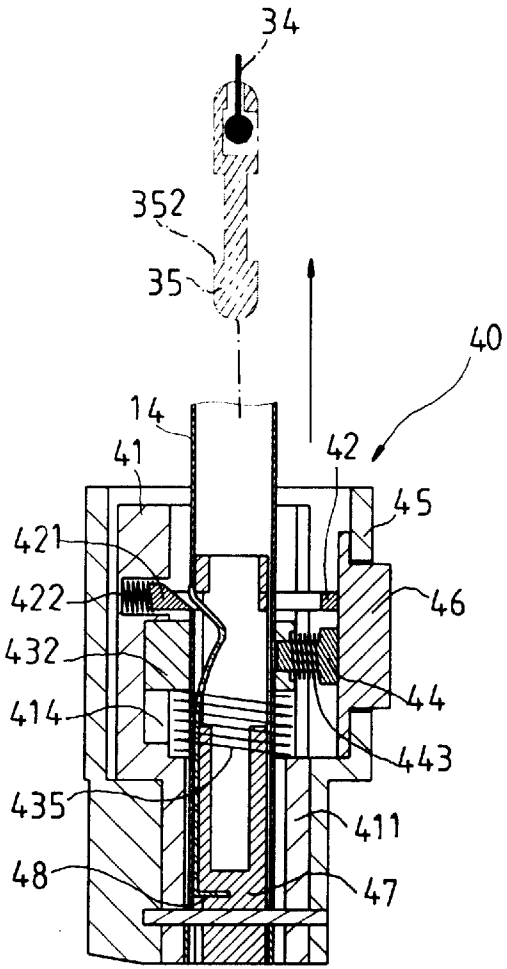
FIG. 8B is a cross sectional view to show the end member bounces upward to fold the umbrella.
Figure 8A:
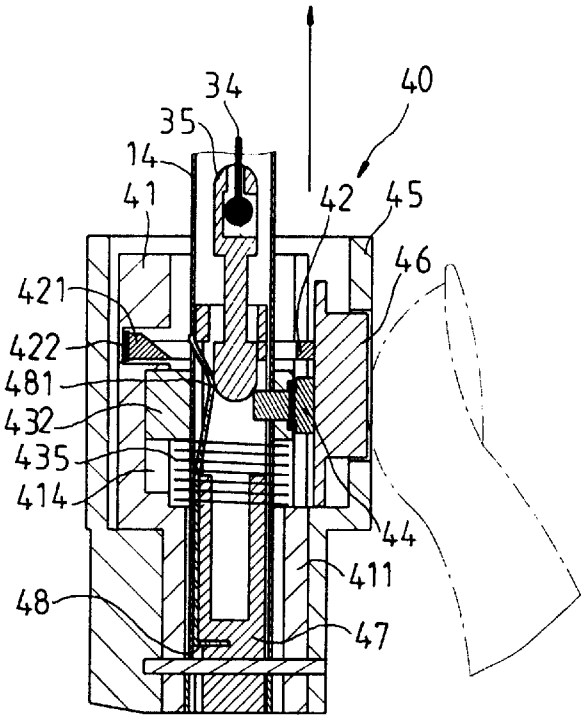
FIG. 8A is a cross sectional view to show when the button of the control device is pushed, the end member is released from the compressing plate.

Referring to FIGS. 7, 8A and 8B, when folding the umbrella, the second button 46 is pushed again and the tongue 442 is inserted into the second aperture 143 in the handle tube 14 and pushes the end member 35 to disengage from the top edge of the tunnel 471. The end member 35 is then lifted by the extended spring 16, the upward movement of the end member 35 loosen the first wire 31 and the second wire 34 so that the runner 26 drops to collapse the umbrella.

While we have shown and described various embodiments in accordance with the present invention, it should be clear to those skilled in the art that further embodiments may be made without departing from the scope and spirit of the present invention.

What is claimed is:

1. A foldable umbrella comprising:

a finishing cap (27) with a plurality of first ribs (21) pivotally connected thereto, a first pulley (15) received in the finishing cap (27), a shaft (10) connected to said finishing cap (27) and comprising a plurality of tubes which are retractably connected with each other, each tube having a hole (112/123/133) defined through a periphery thereof, a handle tube (14) connected to a low end of said shaft (10) and a control device (40) connected to said handle tube (14), said handle tube (14) having a first aperture (142) and a second aperture (143) defined therethrough, a runner (26) movably mounted to said shaft (10) and a plurality of stretchers (22) pivotally connected between said runner (26) and said ribs (21), a fabric mounted to said ribs (21);

a spring (16) received in said shaft and having a first end thereof engaged with a retaining tube (36) which is movably received in said shaft (10);

a first wire (31) having a first end thereof fixedly connected to said finishing cap (27) and a second end of said first wire (31) reeving through a second pulley (261) in said runner (26) and said first pulley (15) in said finishing cap (27) and being fixedly connected to a first block (33) received in said retaining tube (36), an end member (35) movably received in said shaft (10) and having an engaging head (350), a second wire (34) having a first end thereof fixedly connected to said end member (35) and a second end of said second wire (34) extending through a second block (32) which is received in said retaining tube (36) and located between said first block (33) and said end member (35), said second end of said second wire (34) reeving through a third pulley (331) in said first block (33) and being fixedly connected to said second block (32), a second end of said spring (16) engaged with said engaging head (350) of said end member (35);

said control device (40) comprising a base member (41) and a central passage defined through said base member (41) in which said handle tube (14) is received, a slot (414) defined through a periphery of said base member (41) and communicating with said central passage, an opening defined in said periphery of said base member (41) and communicating with said central passage, said opening located diametrically opposite to said slot (414), a carrying member (43) movably inserted in said opening and having a hole (431) defined therein which is in alignment with said central passage, a spring (435) biased against a bottom of said carrying member (43), a protrusion (432) extending from said carrying member (43) and movably engaged with said slot (414), a groove (412) defined in an inner periphery of said central passage and a ring (42) movably received in said groove (412), a projection (421) extending radially inward from an inner periphery of said ring (42), a tube (47) fixedly engaged with said central passage in said base member (41) and received in said handle tube (14), a tunnel (471) defined through said tube (47) and communicating with said first aperture (142) and said second aperture (143) in said handle tube (14), a pressing plate (48) connected to said tube (47) and having a convex portion (481) which is inserted in said tunnel (471) and pressing against said end member (35) when said umbrella is folded, said projection (421) inserted in said tunnel (471) and engaged with said holes (112/123/133) in said retracted tubes of said shaft (10) when said umbrella is folded;

a first button (44) having a plate (441) and a tongue (442) extending from said plate (441), a spring (443) mounted to said tongue (442) and biased between said plate (441) and said carrying member (43), and a second button (46) having a board, said ring (42) and said plate (441) of said first button (44) contacting said board, thereby, the umbrella is expanded by pushing said second button and folded by pushing the second button again.

2. The foldable umbrella as claimed in claim 1 further comprising two ridges (413) extending radially from said inner periphery of said central passage in said base member (41), said carrying member (43) having two notches (434) defined therein, said two ridges (413) engaged with said notches (434).

3. The foldable umbrella as claimed in claim 1 wherein said projection (421) has an inclined surface.

4. The foldable umbrella as claimed in claim 1, wherein said convex portion (481) is located in alignment with said first aperture (142) of said handle tube (14).

5. The foldable umbrella as claimed in claim 1, wherein said engaging member (35) has a shoulder portion (352) which is engaged with a periphery defining said tunnel (471) of said tube (47).

* * * * *